US008164011B1

(12) United States Patent
Dunbar

(10) Patent No.: US 8,164,011 B1
(45) Date of Patent: Apr. 24, 2012

(54) MEDICAL DEVICE MANUAL TRANSDUCER SWITCH

(75) Inventor: Lee Dunbar, Bothell, WA (US)

(73) Assignee: SonoSite, Inc., Bothell, WA (US)

( * ) Notice: Subject to any disclaimer, the term of this patent is extended or adjusted under 35 U.S.C. 154(b) by 360 days.

(21) Appl. No.: 12/404,044

(22) Filed: Mar. 13, 2009

(51) Int. Cl.
*H01H 35/00* (2006.01)

(52) U.S. Cl. ..... 200/52 R; 439/189

(58) Field of Classification Search ..... 200/52 R; 439/189

See application file for complete search history.

(56) References Cited

U.S. PATENT DOCUMENTS 3,660,759 A * 5/1972 Parmater ..... 324/429
6,186,806 B1 * 2/2001 Suzuki et al. ..... 439/189

* cited by examiner

*Primary Examiner* — Elvin G Enad
*Assistant Examiner* — Lisa Homza
(74) *Attorney, Agent, or Firm* — Fenwick & West LLP

(57) ABSTRACT

Systems and methods are disclosed which allow for mechanically switching the electrical connections to a device to which multiple transducers are permanently physically connected. In one embodiment, two transducers are connected to the device on a semi-permanent basis and contacts within the mechanical switch are moved physically by the user to adjust the electrical connection to the desired active transducer. In the embodiment, the mechanical switch moves the entire electrical contact housing from one transducer to another.

18 Claims, 4 Drawing Sheets

MEDICAL DEVICE MANUAL TRANSDUCER SWITCH

TECHNICAL FIELD

This disclosure is related to transducer switches for medical devices and more particularly to systems and methods for simplifying the interchange of medical device transducers.

BACKGROUND OF THE INVENTION

Many medical devices, such as sonographic devices, allow a user to change transducers from time to time. One method for changing such transducers is to simply unplug the first transducer and plug a second transducer into the same physical socket. However, this is not practical for a variety or reasons. Thus, in some situations it is desirable to allow more than one transducer to remain physically attached concurrently to the equipment. In order to allow more than one transducer to be concurrently connected to the device it is necessary to have one or more switches that allow the user to select which of the physically connected devices is also electrically connected at any given time.

In one prior art system, three transducers (scan heads) are physically connected to a single medical device. Electronic relays operating under control of a user operated switch serves to electrically connect a selected one of the three scan heads to the device. These relays, and their accompanying electronics, require power to operate and are relatively expensive to both manufacture and maintain. Thus such switches become a controlling cost factor in the manufacturing of the medical device. This cost is ultimately passed along to the patient. Accordingly, it is desired to reduce the cost of connecting multiple transducers to a common medical device.

BRIEF SUMMARY OF THE INVENTION

The present invention is directed to systems and methods which allow for mechanically switching the electrical connections to a device to which multiple transducers are permanently physically connected. The costly relays and their electronic control circuitry are eliminated from the cost of the medical device by using a mechanical switch. In one embodiment, two transducers are connected to the device on a semi-permanent basis and contacts within the mechanical switch are moved physically by the user to adjust the electrical connection to the desired active transducer. In the embodiment, the mechanical switch moves the entire electrical contact housing from one transducer to another.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawing, in which.

DETAILED DESCRIPTION OF THE INVENTION

Figure 1A:
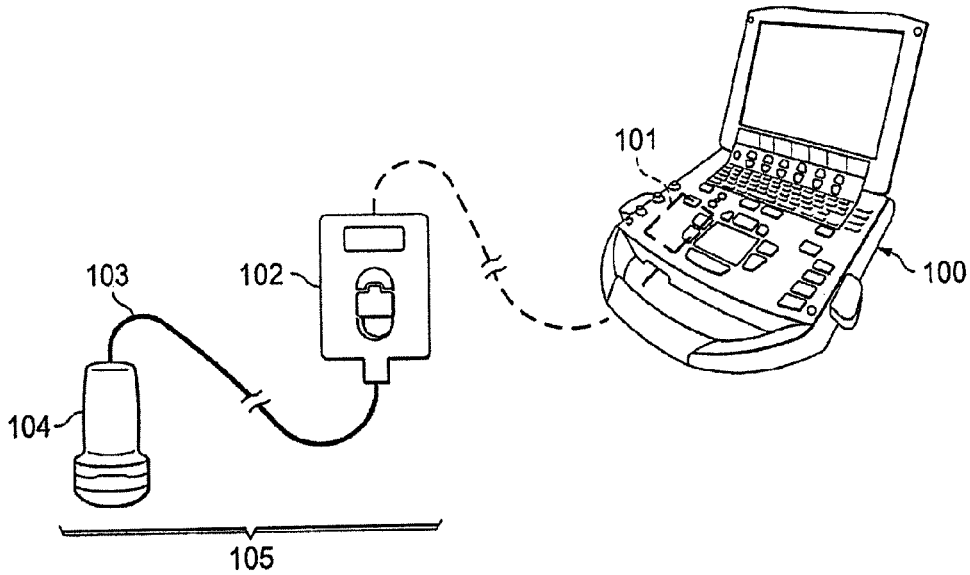
FIG. 1A (Prior Art)
FIGS. 1A and 1B illustrate an example of the prior art transducer switch.
Figure 1B:
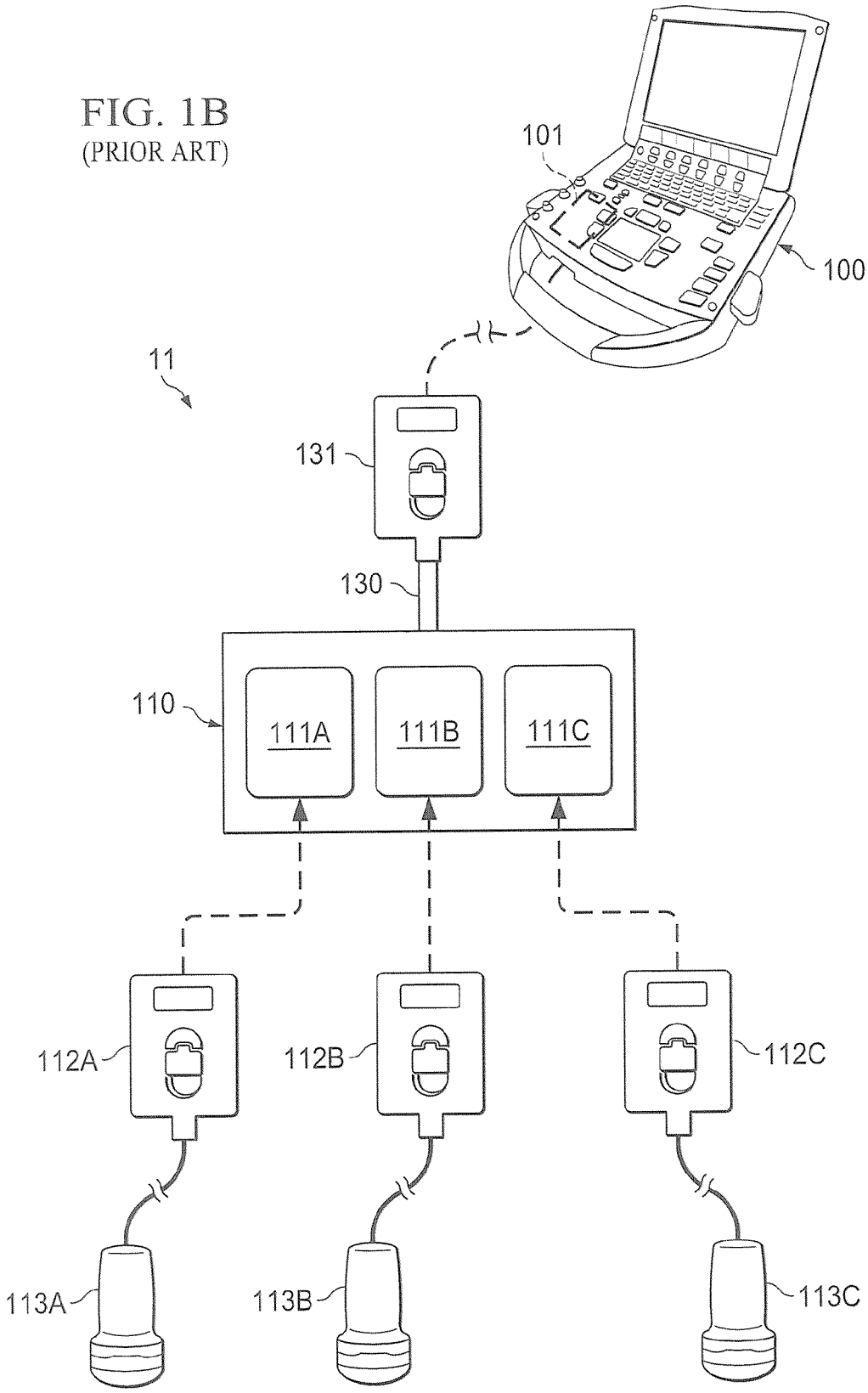
FIG. 1B (PRIOR ART)

FIGS. 1A and 1B illustrate an example of a prior art transducer switch. As shown in FIG. 1A, ultrasound device 100 has connector 101 positioned to accept mating connector ends of a transducer, such as transducer 105, so that the transducer will make both physical and electrical connection to device 100 via connector 101. As shown, scan head 104 of transducer 105 is electrically connected to connector 102 via cable 103. In turn, connector 102 from transducer 105 is connected ultrasound device 100 via connector 101. Often a latch mechanism (not shown) is used to prevent the mated connectors from disengaging. When a user desires to switch transducers the user would have to disconnect connector 102 from connector 101 by disengaging the latching mechanism. The connector from a different transducer would then be then put on a different transducer assembly for a different application or use.

FIG. 1B illustrates prior art ultrasound device 100 having triple connector 110 plugged into connector 101. Connector assembly 131 is used to interface between connector 100 on triple connector board 110 and device connector 101. Assembly 131 in the embodiment shown connects to triple connector 110 via cable 130. This arrangement expands the system's capability from having one physical transducer connection to having three physical transducer connections 111A, 111B and 111C. This then allows three transducers to be semi-permanently connected to the device at the same time.

A set of electronic relays and other controls are positioned on triple connector 110 and serve to switch the electrical connection from one of the transducers to triple connector 101 as desired by the user from time to time. A switch, not shown, is also positioned on triple connector 110 which allows the user to make the selection among the transducers. When the user desires to switch from one transducer to another, the user operates the appropriate switch (or turns a rotary switch to the proper position which in turn operates the relays and electronically switches the wires from one transducer to another. Typically there are approximately two hundred wires that must be switched each time. Some of these wires are power wires, some are ground wires and some are bi-directional transmit/receive wires going to the transmitter elements.

Figure 2:
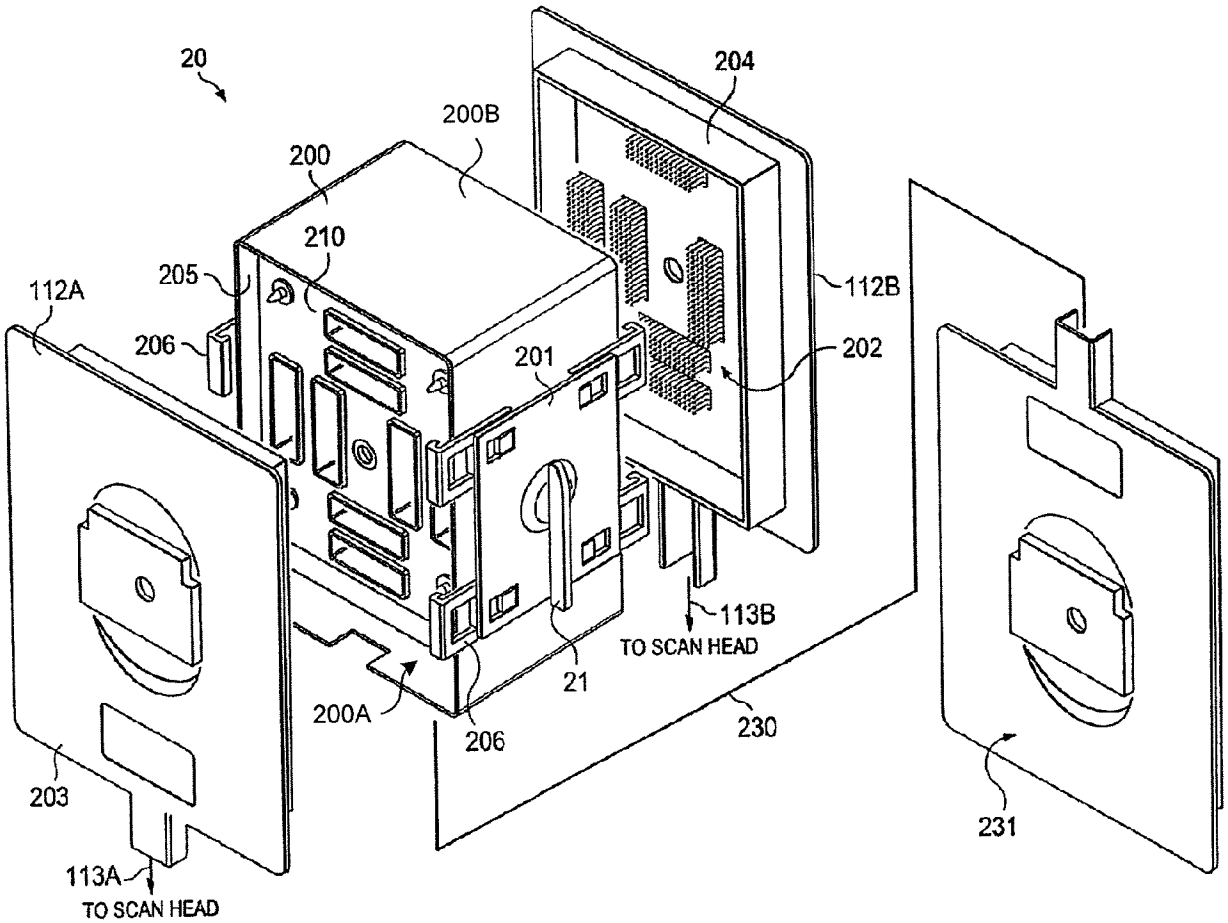
FIG. 2 shows one embodiment of a transducer switch in accordance with one concept of the invention.

FIG. 2 shows one embodiment 20 of transducer switch box 200 in accordance with one concept of the invention. Transducer connector 112A serves to connect scan head 113A to the medical device (not shown in FIG. 2). Transducer connector 112B serves to connect scan head 113B to the medical device (not shown in FIG. 2). Transducer switch box 200 houses a set of contacts moveable between a first side 200A and a second side 200B which, as will be discussed, engage electrical contacts in one or the other of transducers connectors 112A or 112B. Transducer switch 200, in this embodiment, is connected to the medical device (as shown in FIG. 1A) by cable 230 and interface connector 231 which mates with device connector 101 (FIG. 1A). The electrical contact points of the connector set, of which there are in the range of two hundred, are arranged into a plurality of individual electrical connectors with each individual connector having, in one embodiment, duel in-line individual electrical connection points or contacts. The purpose of the movable contact set is to make electrical contact between the respective contact points substantially simultaneously.

In operation, when the user desires to use a particular transducer (for example, scan head 113B) then the user operates switch 21 toward the desired transducer connector (in this example it would be rotated clockwise). This then moves a contact block 210 within transducer switch box 200 to the right such that the electrical contacts on the right side of contact block 210 mate with contacts 202 within transducer connector 112B. This serves to make the electrical connection between scan head 113B and medical device 100 (FIG. 1A) via connectors 231 and 101.

Note that switch 21 is shown as a rotary switch but it can be any type of switch or lever which causes contact block 210 to move from one transducer connector to the other. In the embodiment shown, the rotary motion of the switch is translated into lateral movement of the contact set. In some embodiments it may be important to insure that the contact set electrically separates from a first transducer connector before making electrical contact with a second transducer connector.

Switch 21 could be a slide switch where the user slides the switch left or right causing the contact block to move in concert therewith. The switch could be connected directly to the movable contact block or it could be connected thereto by a linkage. Support 201 provides support for switch 21 as well as is a cover of switch box 200 if desired. Outer flanges 206 of support 201 flex such that they wrap around outside 203 of transducer connector 112A in order to maintain transducer connector 112A or connector 112B in physical contact with the transducer switch box 200 and in a fixed relationship therewith. Proper positioning of transducer connector 112A with transducer switch box 200 can be accommodated by lip 204 around the leading edge of transducer connector 112A mating tightly with inner edge 205 transducer switch 200.

Note that while only two transducer connectors are shown on transducer switch box 200 any number of transducers could be positioned, provided the contacts of contact block 210 could be selectively positioned manually to contact only one transducer at a time. One embodiment for accomplishing such a multi-ported arrangement would be to position a manual rotary switch on the top of the housing and to then have the contact set within the housing rotate in an arc, or even a full circle. In such an arrangement, the various transducer connectors would be positioned at ports around the circumferential periphery of the housing. In such an embodiment, the rotary switch would pivot about an axis parallel to the axis of the transducer connectors. Note also, that if desired, a neutral position could be established where the contact set would not make electrical contact with any transducer connector.

Figure 3:
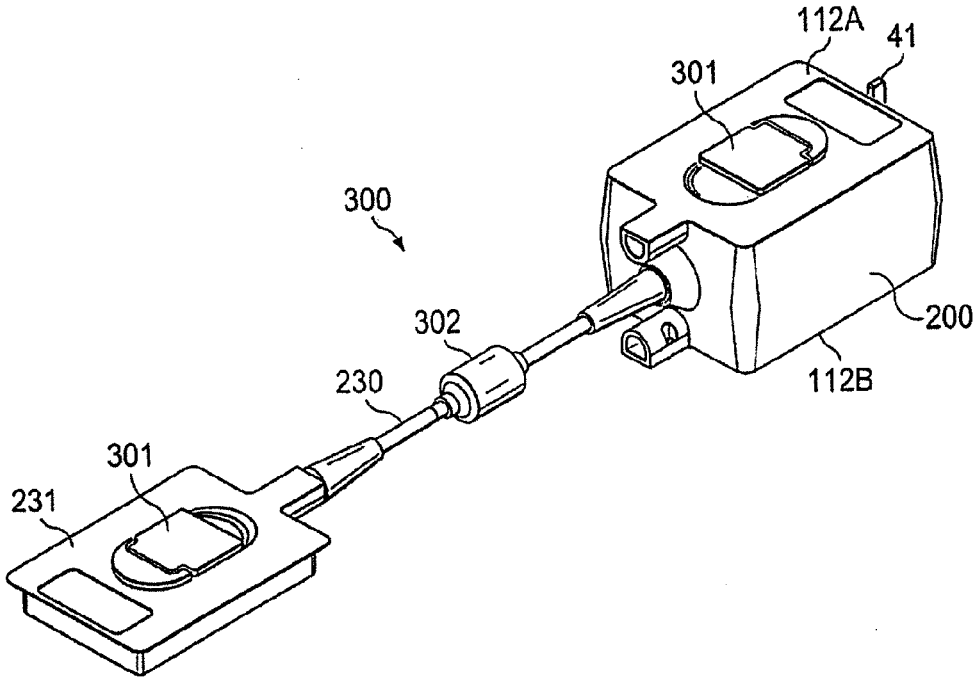
FIG. 3 shows one embodiment of the switch with two transducers attached.

FIG. 3 shows one embodiment 300 of transducer switch box 200 with two transducers connectors 112A and 112B attached. Shown also is device connector 231 which, as discussed above, is designed to mate with the interface connector of the medical device. The design of device connector 231 is the same as the design of transducer connectors 112A and 112B since they all are designed to mate with the device interface connector (shown as connector 101 in FIG. 1A). Latch 301 operates to maintain the transducer connector physically mated with the device, or with transducer switch box 200 until released by the operator/user. Filter 302 is optionally positioned in cable 230 to enhance signal propagation as is well-known. Note that, lever 41 is similar to switch 21 (FIG. 2) except that the lever 41 (switch) for selecting which transducer is electrically coupled to device connector 231 is on the top, (far right in FIG. 3 and shown in more detail in FIG. 4).

Figure 4:
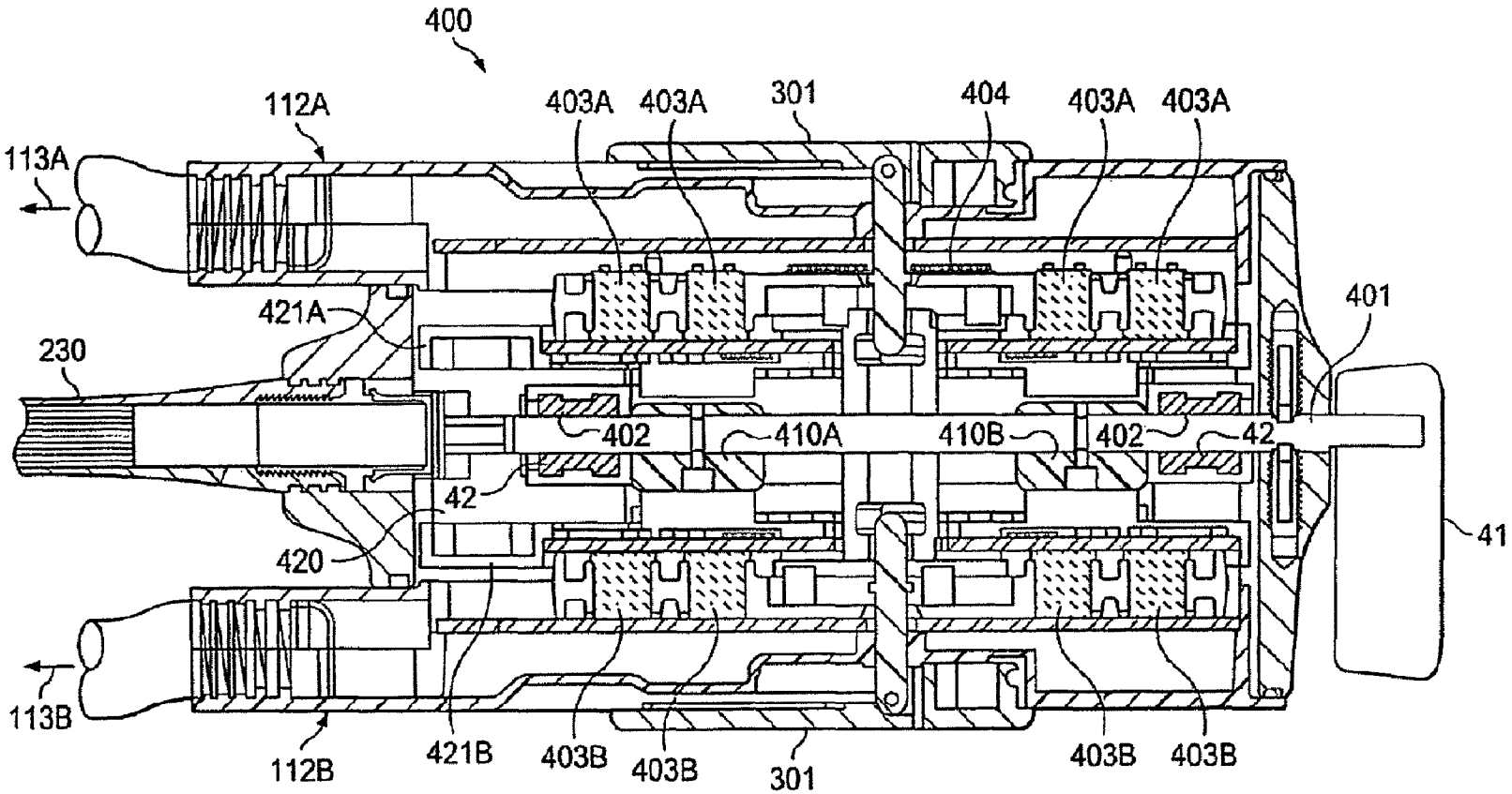
FIG. 4 shows one embodiment of the details of the operation of the switch shown in FIG. 3.

FIG. 4 shows one embodiment 400 of the details of the operation of a switch which could be used as a transducer switch box 200 (FIGS. 2 and 3). Contact set 420 consists of two faces 421A and 421B, with each faces having sets of electrical contacts, such as contacts 404, mounted into connectors, such as connectors 403A on face 421A and connectors 403B on face 421B. In the embodiment shown, the electrical contacts of face 421A are mated with electrical contacts within transducer connector 112B.

When the user turns lever (switch) 41 center rod 401 rotates within bearings 42. This rotation causes cams 410A and 410B to rotate in the same direction as lever 41. As cams 410A and 410B rotate they force contact set 420 to move closer to one of the transducer connectors and simultaneously away from the other of the transducer connectors. Thus, if the user were to rotate lever 41, cams 410A ands 410B would force contact set 420 to move away from transducer connector 112B and toward transducer connector 112A. This, in turn, would cause the electrical connections between face 421B and connector 112B to become physically separated. At some point along the movement, connectors 403A would electrically mate with the electrical connectors within transducer connector 112A, thereby transferring the electrical connection of the medical device from scan head 113B to scan head 113A.

Note that while a movable contact set is shown, the concept of a mechanical switch could be implemented in many ways. For example, the concept could be implemented by having each transducer connector electrically connected at all times when it is physically connected to the switch housing. In such an embodiment, the electrical connections, (about two hundred of them) would be brought to the center of the switch by wires or buses from all of the contacts of all of the physically connected transducer connectors. At or near the center of the switch, a commutator having a plurality of individual electrical contacts positioned thereon could be arranged to rotate into selective electrical contact with the wires (or buses) from one or the other of the connected transducer connectors. The commutator would be turned, or slid into the selected position under control of a lever operated by the user. This then would serve to manually connect only one of the scan heads with the medical device at any one point in time.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A medical device transducer switch comprising;

a housing for supporting at least two transducer connectors, each transducer connector having a plurality of transducer connector contacts, said transducer connector contacts in electrical communication with a scan head of a transducer;

a set of connector contacts movably positioned within said housing;

a device connector having a plurality of electrical contacts for making electrical contact between said set of connector contacts and a medical device; and a switch physically linked to said set of connector contacts such that a movement of said switch causes said set of connector contacts to move from an electrically mated relationship with said plurality of transducer connector contacts of a first supported transducer connector to an electrically mated relationship with said plurality of transducer connector contacts of a second supported transducer connector.

2. The switch of claim 1 wherein said switch is a rotary switch and wherein a rotary motion of said switch translates to lateral motion of said set of connector contacts between said first and second transducer connectors.

3. The switch of claim 1 further comprising:

means for maintaining at least two of said transducer connectors in simultaneous mated physical contact with said housing.

4. The switch of claim 1 wherein said plurality of connector contacts within each transducer connector and within said movable set of connector contacts and within said device connector is in the range of two hundred.

5. The switch of claim 1 wherein said set of connector contacts are arranged into a plurality of separate connectors, each separate connector having a dual line of individual contacts.

6. The switch of claim 1 wherein said set of connector contacts comprises:

a movable structure having opposing faces, each face having a full set of electrical contacts, each said set of electrical contacts positioned for connection to respective electrical contacts within said transducer connector.

7. The switch of claim 1 wherein said plurality of connector contacts on one of the transducer connectors and the set of moveable set of connector contacts within the housing are mated by moving the set of connector contacts into a physical mated relationship with said connector contacts of one of the transducer connectors.

8. A method of concurrently connecting a plurality of medical transducers to a medical device having an interface connector, said interface connector comprising a plurality of individual electrical connection points, said method comprising:

mating an electrical connector from an intermediate switch with said interface connector;

mating at least two transducer electrical connectors from individual medical transducers to individual ports of said intermediate switch; and moving a lever located on said intermediate switch, said lever being physically linked to an electrical contact set within said intermediate switch, such that said movement of said lever causes a moveable contact set within said intermediate switch to move from an electrically mated relationship with a first one of said transducer electrical connectors to an electrically mated relationship with a second one of said transducer electrical connectors thereby causing a transducer electrically connected to said second transducer connector to become electrically connected to said medical device replacing an electrical connection from a transducer electrically connected to said first transducer connector.

9. The method of claim 8 wherein said lever comprises a rotary switch and wherein said moving comprises translating a movement of said lever to movement of an electrical contact set between said first and second transducer connectors.

10. The method of claim 9 wherein said movement is a lateral movement that causes electrical contact between said contact set and said first transducer to separate before electrical contact between said contact set and said second transducer is made.

11. The method of claim 8 wherein said movable contact set comprises:

a movable structure having opposing faces, each face having a set of electrical contacts, each said set of electrical contacts positioned for connection to respective electrical contacts within said transducer connector.

12. A medical device switch comprising:

means for making electrical connection between said switch and a medical device, said electrical connection comprising N number of individual electrical contacts;

means for making physical connection between said switch and first and second transducer connectors, each said transducer connector comprising N number of individual electrical contacts; and a contact block positioned within said switch, said contact block having at least first and second faces, each face comprising N number of individual electrical contacts; and means for selectively moving said contact block such that said N electrical contacts of said first face of said contact block are in electrically mated relationship with said N electrical contacts of said first transducer connector when said contact block is moved to a first position and such that said N electrical contacts of said second face of said contact block are in electrically mated relationship with said N electrical contacts of said second transducer connector when said block is moved to a second position and such that at any time only one set of contacts are in said mated relationship.

13. The switch of claim 12 wherein N is in the range of two hundred.

14. The switch of claim 13 wherein said moving means comprises a lever mounted on said switch.

15. The switch of claim 14 further comprising:

a cam located within said switch, said cam forcing said contact block to move in cooperation with movement of said lever.

16. The switch of claim 15 wherein said physical connection means for maintaining said transducer connectors in fixed physical relationship with said switch for a period of time is controlled by a switch user.

17. The switch of claim 16 wherein said contact block comprises:

a movable structure having opposing faces, each face having a set of electrical contacts, each said set of electrical contacts positioned for connection to respective electrical contacts within said transducer connector.

18. The switch of claim 12 wherein said electrically mated relationship comprises a physically mated relationship as well.

* * * * *